US007146777B2

(12) United States Patent
Focke et al.

(10) Patent No.: US 7,146,777 B2
(45) Date of Patent: Dec. 12, 2006

(54) PACKAGING MACHINE FOR CIGARETTES

(75) Inventors: Heinz Focke, deceased, late of Verden (DE); by Jurgen Focke, legal representative, Verden (DE); by Doris Focke, legal representative, Verden (DE); Jürgen Tempel, Verden (DE); Gisbert Engel, Kirchlin-teln-Luttum (DE)

(73) Assignee: Focke & Co. (GmbH & Co.), Verden (DE)

( * ) Notice: Subject to any disclaimer, the term of this patent is extended or adjusted under 35 U.S.C. 154(b) by 12 days.

(21) Appl. No.: 10/472,826

(22) PCT Filed: Feb. 8, 2002

(86) PCT No.: PCT/EP02/01317

§ 371 (c)(1),
(2), (4) Date: Jun. 9, 2004

(87) PCT Pub. No.: WO02/078942

PCT Pub. Date: Oct. 10, 2002

(65) Prior Publication Data

US 2005/0164858 A1 Jul. 28, 2005

(30) Foreign Application Priority Data

Mar. 28, 2001 (DE) ..... 101 15 563

(51) Int. Cl.
*B65B 57/04* (2006.01)

(52) U.S. Cl. ..... 53/52; 53/57; 53/210; 53/234; 53/575

(58) Field of Classification Search ..... 53/52, 53/57, 58, 201, 234, 575
See application file for complete search history.

(56) References Cited

U.S. PATENT DOCUMENTS

| | | | | |
|---|---|---|---|---|
| 2,892,475 | A * | 6/1959 | Lapsley | 144/48.1 |
| 3,956,870 | A * | 5/1976 | Kruse et al. | 53/55 |
| 4,520,612 | A * | 6/1985 | Muller | 53/48.9 |
| 4,565,048 | A * | 1/1986 | Lade | 53/201 |
| 4,711,065 | A * | 12/1987 | Focke et al. | 53/170 |
| 4,860,519 | A * | 8/1989 | Lemaire et al. | 53/167 |
| 5,056,294 | A | 10/1991 | Focke | |
| 5,394,975 | A | 3/1995 | Bernhard | |
| 5,537,798 | A | 7/1996 | Fukuda et al. | |
| 5,549,537 | A * | 8/1996 | Focke et al. | 493/162 |
| 5,558,611 | A * | 9/1996 | Focke | 493/162 |
| 5,701,718 | A | 12/1997 | Spada | |
| 6,000,195 | A * | 12/1999 | Jakobsson | 53/201 |
| 6,035,603 | A * | 3/2000 | Focke et al. | 53/52 |
| 6,280,372 | B1 * | 8/2001 | Focke et al. | 493/8 |

(Continued)

FOREIGN PATENT DOCUMENTS

DE 26 56 218 B1 4/1978

(Continued)

*Primary Examiner*—Rinaldi I. Rada
*Assistant Examiner*—Hemant M. Desai
(74) *Attorney, Agent, or Firm*—Sughrue Mion, PLLC

(57) ABSTRACT

For the production of (cigarette) packs of different configurations, for example standard pack (13), round-edged pack (14) or octagonal pack (15), subassemblies and elements of the packaging machine are exchanged and/or uncoupled from the drive. For this purpose, a pack-specific operating element is provided with a drive which has a coupling and/or uncouplable gear-mechanism parts. These, in turn, are assigned operable handling elements which allow adjustment for coupling or uncoupling or removing sub-elements.

13 Claims, 7 Drawing Sheets

U.S. PATENT DOCUMENTS

| | | | | |
|---|---|---|---|---|
| 6,484,475 | B1 * | 11/2002 | Neagle et al. | 53/167 |
| 6,666,803 | B1 * | 12/2003 | Spatafora | 483/16 |
| 6,675,555 | B1 * | 1/2004 | Monti | 53/167 |
| 6,688,077 | B1 * | 2/2004 | Focke et al. | 53/234 |
| 6,745,454 | B1 * | 6/2004 | Grimshaw et al. | 29/563 |

FOREIGN PATENT DOCUMENTS

| | | | |
|---|---|---|---|
| DE | 35 15 775 | A1 | 11/1986 |
| DE | 41 00 239 | A1 | 7/1992 |
| DE | 44 04 278 | A1 | 8/1995 |
| DE | 197 06 215 | A1 | 8/1998 |
| DE | 197 07 685 | A1 | 8/1998 |
| DE | 199 41 485 | A1 | 10/2000 |
| EP | 645 307 | A1 | 9/1994 |
| EP | 667 230 | A1 | 8/1995 |
| EP | 667 232 | A1 | 8/1995 |
| EP | 1 020 365 | A1 | 12/1999 |
| JP | 6-32325 | | 2/1994 |
| JP | 8-11203 | | 1/1996 |
| JP | 8-133223 | | 5/1996 |
| JP | 2762736 | | 3/1998 |
| JP | 10-245007 | | 9/1998 |
| JP | 10-305813 | | 11/1998 |
| JP | 2000-171235 | | 6/2000 |
| WO | WO 00 44621 | A2 | 8/2000 |

* cited by examiner

PACKAGING MACHINE FOR CIGARETTES

This application is the National Stage of International Application No. PCT/EP02/01317 filed Feb. 8, 2002.

BACKGROUND OF THE INVENTION

The invention relates to a packaging machine, in particular for producing cigarette packs, having folded subassemblies and elements for folding blanks and having conveying elements for transporting packaging material and (partly) finished packs.

In the cigarette industry, there is increasing interest in producing cigarette packs of different configurations, in particular of different designs. On account of the variety of packs which can be produced, in some circumstances in limited quantities, there is a corresponding requirement for converting packaging machines from one type of pack to another.

SUMMARY OF THE INVENTION

The object of the invention is to design packaging machines, in particular for producing cigarette packs, such that conversion from one type of pack to another can be reliably carried out within a short period of time.

In order to achieve this object, the packaging machine according to the invention is characterized in that, in the case of production changeover, in particular in respect of size and/or configuration of the (cigarette) pack, folding subassemblies and/or elements and/or conveying elements can be wholly or partially exchanged or uncoupled from the drive.

The correct and complete exchange or changeover of the elements and subassemblies concerning the relevant features of the packs is checked, according to the invention, by sensors, in particular by contactless initiators. These are connected to a central control unit. A signal for starting up the packaging machine for producing a new type of pack is given when the subassemblies and elements which can be exchanged or changed over or uncoupled from the drive are completely ready for the new type of pack.

The invention concerns, in particular, a packaging machine for producing cigarette packs of the hinged-lid (-box) type). One special feature of the invention consists in converting the packaging machine alternatively to standard packs of this type, to packs with beveled pack edges (octagonal pack) or to packs of rounded pack edges (round corner pack). For this purpose, selected elements and subassemblies are exchanged, changed over or uncoupled from the drive.

BRIEF DESCRIPTION OF THE DRAWINGS

Details of the packaging machine according to the invention and of these specifically designed pack-specific elements and subassemblies are explained hereinbelow with reference to the patent drawings, in which.

Figure 1:
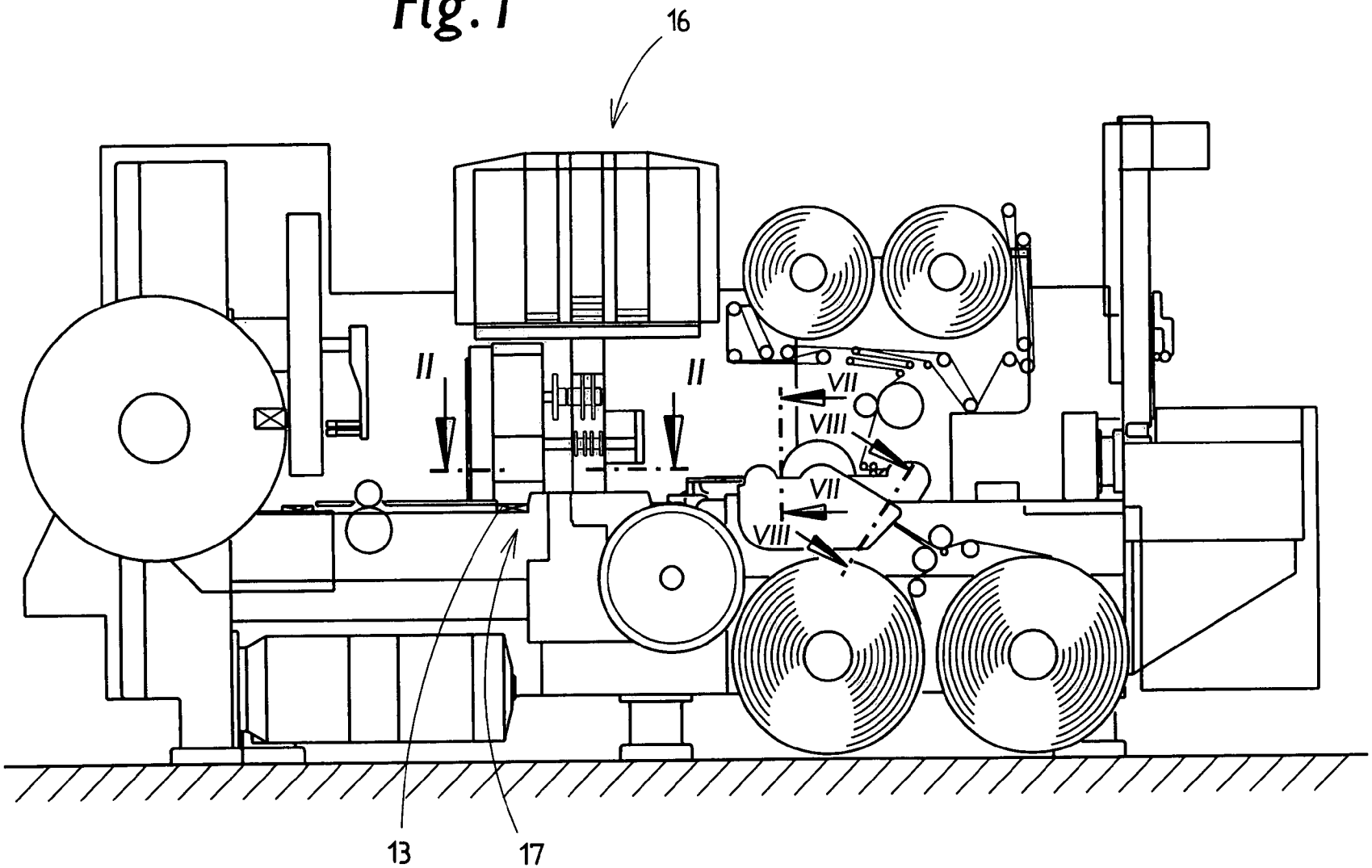
FIG. 1 shows a schematic side view of a packaging machine for producing hinged-lid boxes.

The packaging machine discussed here (FIG. 1) serves for producing cigarette packs of the hinged-lid-box type. The use of this type of packet is particularly widespread throughout the world. The hinge-lid box is constructed from a blank made of thin cardboard for forming a bottom box part 10 and a lid 11, which is connected to the latter in a pivotable manner. A collar 12 arranged within the hinge-lid box comprises a separate blank.

DETAILED DESCRIPTION OF THE INVENTION

The packaging machine can be adjusted and/or converted for producing hinge-lid boxes or hinge-lid packs in different, in this case three, configurations (FIG. 9), specifically a standard pack 13 with cross-sectionally right-angled (upright) pack edges, a round-edged pack 14 with rounded pack edges and an octagonal pack with beveled pack edges.

Figure 3:
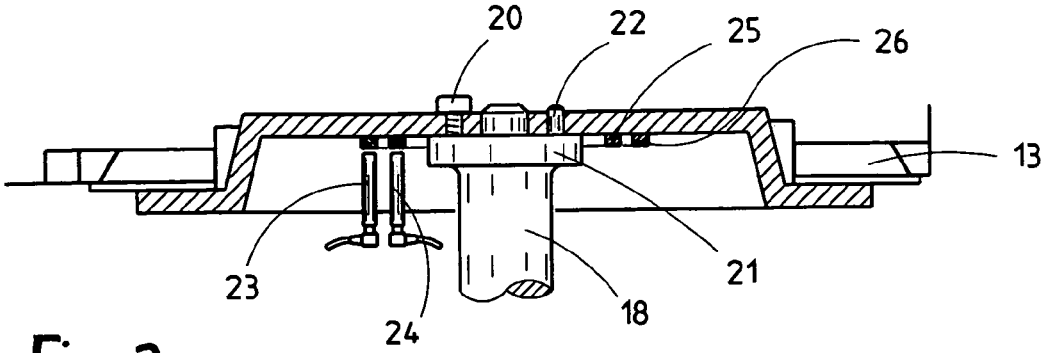
FIG. 3 shows the detail according to FIG. 2 in cross section, namely along section III—III from FIG. 2.
Figure 2:
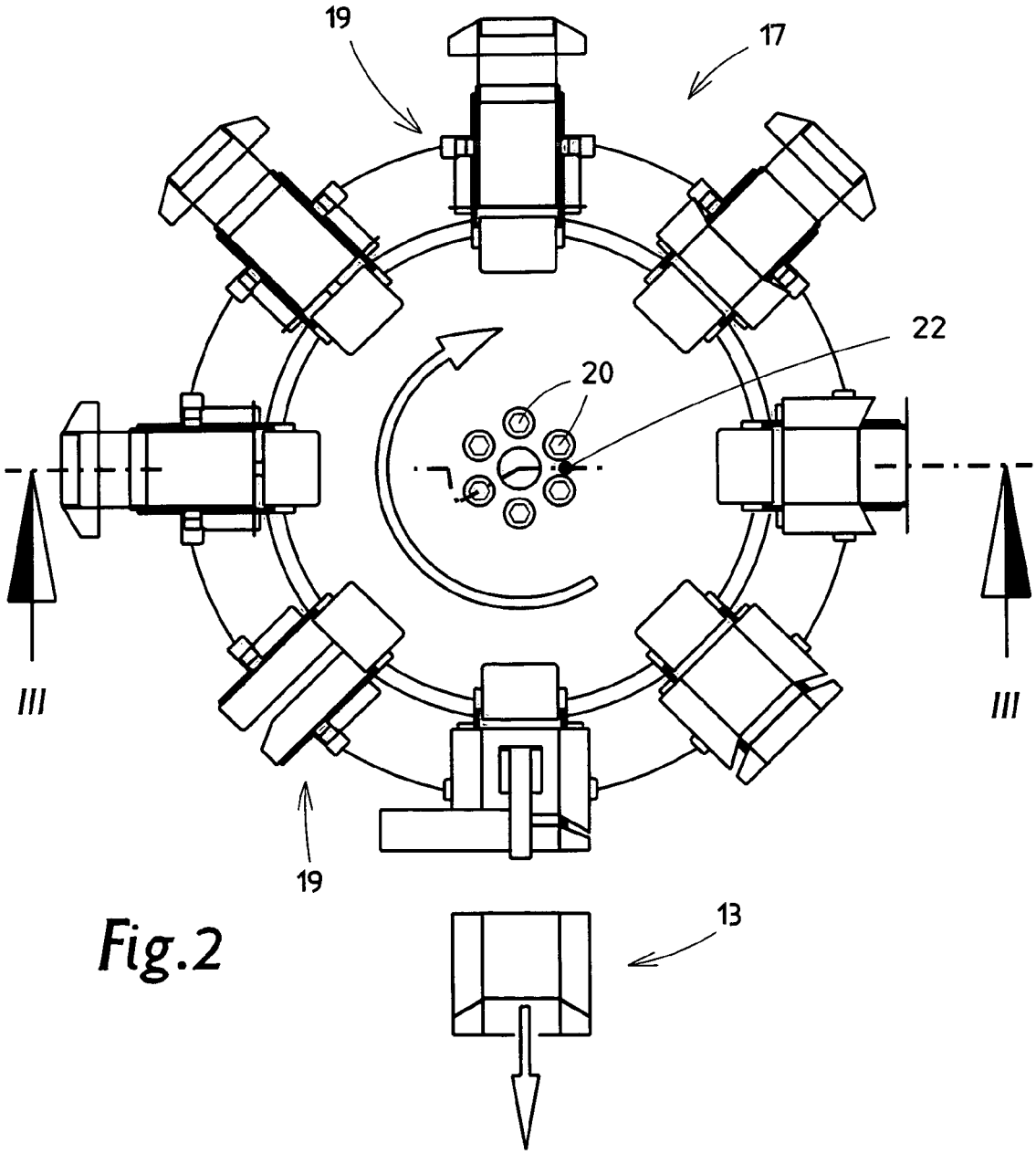
FIG. 2 shows, in plan view or along a section plane II—II from FIG. 1, a detail of the packaging machine according to FIG. 1, namely a folding turret.

During the production of hinge-lid boxes, the packaging machine is supplied with prefabricated blanks in stacks. The stacks of blanks are held ready in a blank magazine 16. The blanks are removed individually from the underside of the latter and fed to a folding turret 17 via a blank path (EP 0 667 230). Said folding turret is of plate-like design (FIG. 2, FIG. 3) and is positioned at the top end of an upright, driven shaft 18. The folding turret 17 is provided, along the circumference, with a number of pockets 19 into which in each case one blank and, subsequently, the pack contents—cigarette blocks—are introduced. The pockets 19 are adapted to the shape of the hinge-lid boxes, that is to say are configured in a manner corresponding to the packs 13, 14, 15.

In the case of this type of pack being changed over, the entire folding turret 17 is exchanged, that is to say replaced by a folding turret 17 with pockets 19 adapted to the respective type of pack. For this purpose, the folding turret 17 is fastened in a releasable manner on the shaft 18, that is to say by means of screws 20 in the region of a carrying flange 21. By virtue of the screws 20, which are arranged all the way round, being released, the folding turret 17 can be removed and a different folding turret can be fastened. For a precise adjustment of the relative position of the folding turret 17, use is made of an adjusting pin 22 on the shaft 18, or on the carrying flange 21, for entering into a precisely positioned bore of the folding turret 17.

(Contactless) sensors, in the present case (two) initiators 23, 24, check as to whether the packaging machine has been correctly equipped with the necessary folding turret 17. Said initiators are assigned in each case to a contact protrusion, in the present case one of two contact rings 25, 26 on the underside of the folding turret 17. With the aid of this monitoring system, it is possible to detect and/or indicate centrally, that is to say via a central (machine) control means 27, whether the correct folding turret 17 for the respective type of pack has been installed. In the case of three different folding turrets, the arrangement may be selected such that either one or the other or both of the contact rings 25, 26 is/are fitted and a corresponding control signal can be derived therefrom.

Figure 4:
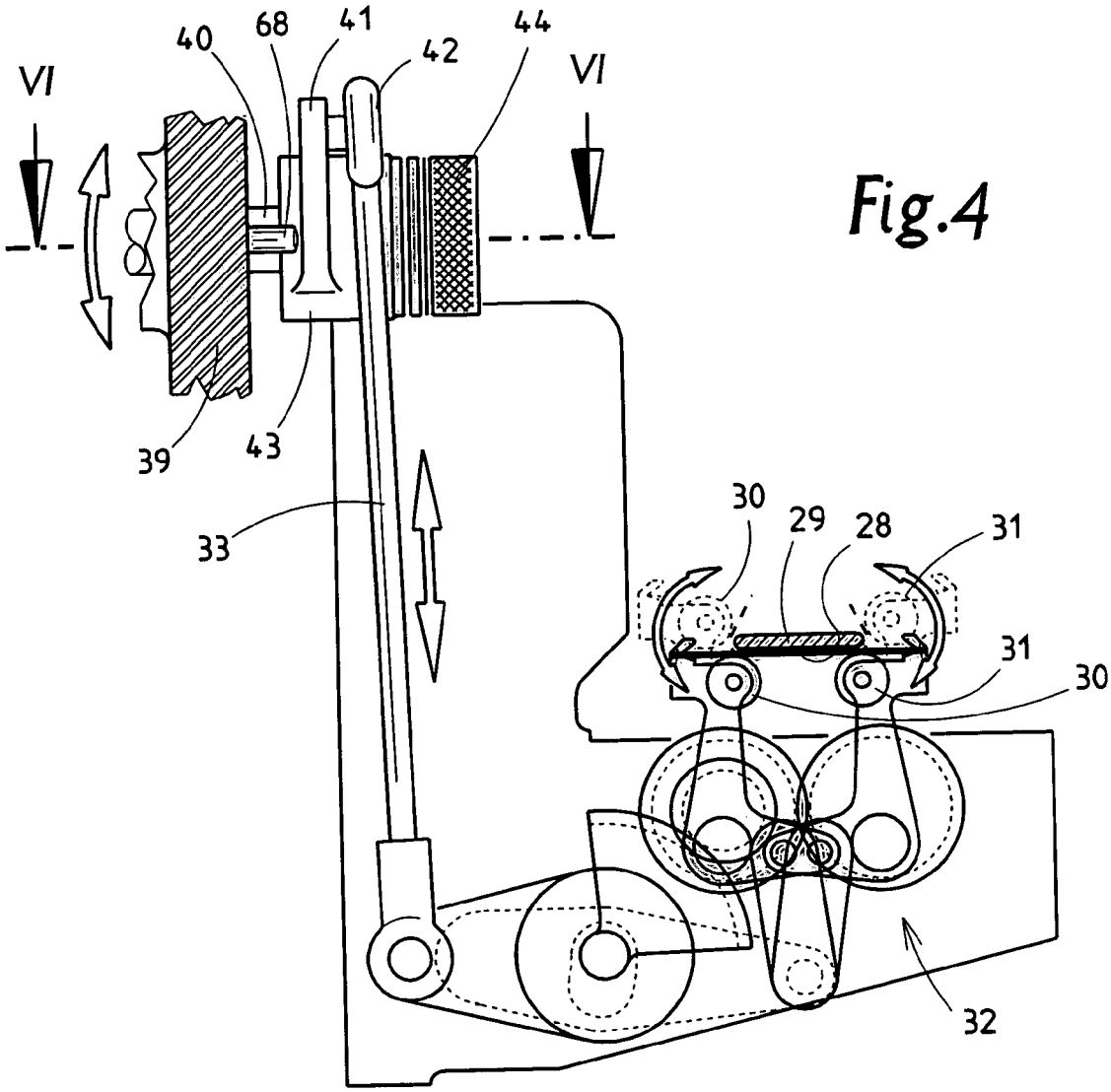
FIG. 4 shows a view, partly in section, of a subassembly for processing blanks, namely for preshaping folding tabs for round-edged packs.
Figure 5:
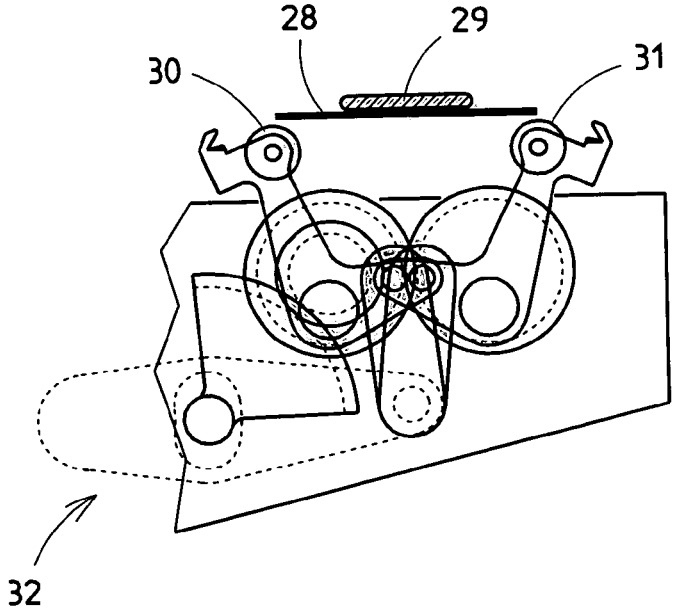
FIG. 5 shows a detail of the subassembly according to FIG. 4 with folding elements in different relative positions.
Figure 6:
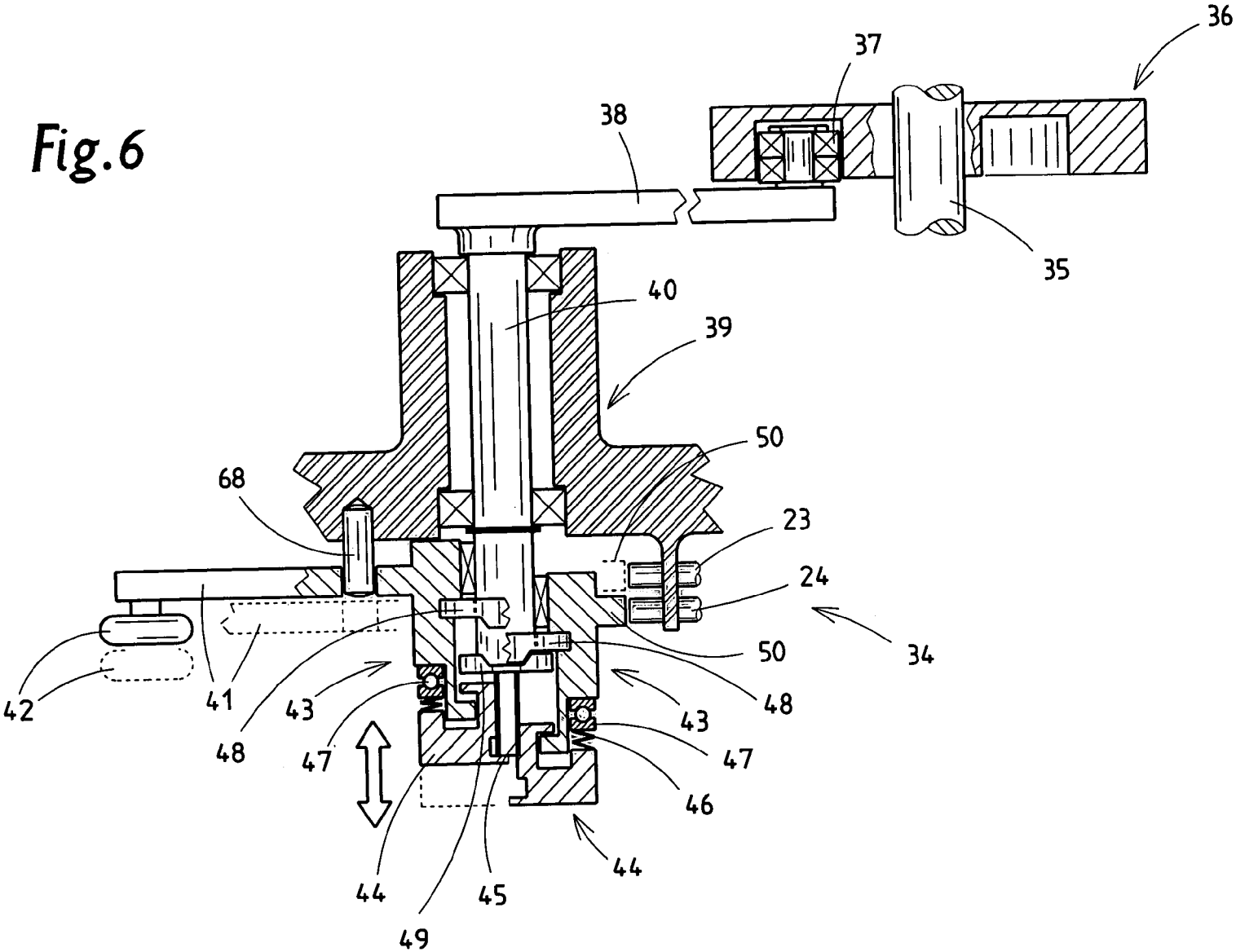
FIG. 6 shows the subassembly according to FIG. 4 in a plan view or in a horizontal section along section plane VI—VI.

One special feature is brought to bear in respect of another subassembly for shaping or prefolding blanks 28. This is a blank or shaping subassembly (EP 0 667 230) for preshaping round edges during the production of round-edged packs 14 (FIG. 4, FIG. 5, FIG. 6).

The subassembly is arranged as standard in the packaging machine, that is to say in the region of the blank path for feeding the blanks 28 from the blank magazine 16 to the folding turret 17. The blanks 28 are positioned, in the region of a shaping station, beneath a shaping body 29 with rounded (or beveled) longitudinal borders. Shaping tools, namely shaping rollers 30, 31, grip folding tabs of the blank 28 which project laterally beyond the shaping body 29, and shape the same by moving upward around the contour of the shaping body 29.

The shaping rollers 30, 31 are moved by a specifically designed gear mechanism 32 (EP 0 667 230). The special feature, then, consists in uncoupling the gear mechanism 32 from its drive and thus bringing the shaping rollers 30, 31 to a standstill as the machine continues running. The arrangement is such that, during the production of standard packs 13 or octagonal packs 15, the shaping rollers 30, 31 remain in a position according to FIG. 5. The shaping rollers 30, 31, but also actuating arms and lateral aligning elements, are brought to a standstill in a position beneath the movement path of the blank 28. Accordingly, the planar, non-folded blank 28 runs through the shaping station without the processing elements, namely the shaping rollers 30, 31 becoming active.

The gear mechanism 32 is connected to a drive via an actuating element, that is to say via a push rod 33, to be precise to a shaft 35 via a further intermediate gear mechanism 34. Said shaft is preferably connected to the central machine drive and circulates continuously. The intermediate gear mechanism 34 transmits drive movements, via the push rod 33, to the gear mechanism 32 of the shaping tools. If the latter are to be rendered inactive, disconnection takes place in the region of the intermediate gear mechanism 34.

A cam plate 36 is mounted on the shaft 35. This cam plate actuates, via a cam roller 37, a pivoting arm 38 which, in turn, is connected to an actuating shaft 40 mounted in a housing component 39. The actuating shaft transmits the drive to a pivoting lever 41 which, for its part, is connected to the push rod 33 via a spherical head 42.

The gear mechanism 32 is disconnected by virtue of the actuating shaft 40 being uncoupled from subsequent gear-mechanism parts. That end of the actuating shaft which is remote from the pivoting arm 38 is connected to the pivoting lever 41 via a coupling which can be operated from the outside. Said pivoting lever is fitted on an axially displaceable sleeve 43, which is displaced axially on the actuating shaft 40 for coupling and disconnection purposes. Provided for this purpose is an adjusting element, that is to say an adjusting wheel 44 that is fitted at the free end. This can be actuated by rotation from the outside, manually or using a suitable tool. The adjusting wheel 44 is mounted on a carrying part, that is to say on a threaded component 45 which is connected to the end of the actuating shaft 40. By virtue of rotation, the adjusting wheel 44 is thus adjusted out of one end position, that is to say the coupled position (FIG. 6, on the right) into the other, disconnection end position (FIG. 6, on the left). The adjusting wheel 44 is supported on an annular bearing 47 of the sleeve 43 via compression springs 46.

The coupling which can be actuated by the adjusting wheel 44 comprises two coupling parts 48 and 49. The former is connected to the sleeve 43, and the latter coupling part is connected to the actuating shaft 40, to be precise at the end of the same. In the coupled position (FIG. 6, on the right), the coupling parts 48, 49 engage in a form-fitting manner one inside the other by way of protrusions and depressions. The rotary movement of the actuating shaft 40 is thus transmitted to the sleeve 43 and, from the latter, to the pivoting lever 41. For disconnection and coupling purposes, the sleeve 43 is thus displaced axially by the adjusting wheel 44. The actuating shaft 40 can continue running following disconnection (FIG. 6, on the left).

It is also the case with this blank subassembly that a check is made of the operating position in respect of the pack which is to be produced. For this purpose, once again, two sensors, namely initiators 23, 24, are provided, a protrusion 50 on the sleeve 43 acting thereon. Depending on the position of this protrusion 50, one initiator 23, 24 or the other is activated. A corresponding signal is given to the central control means 27.

Figure 7:
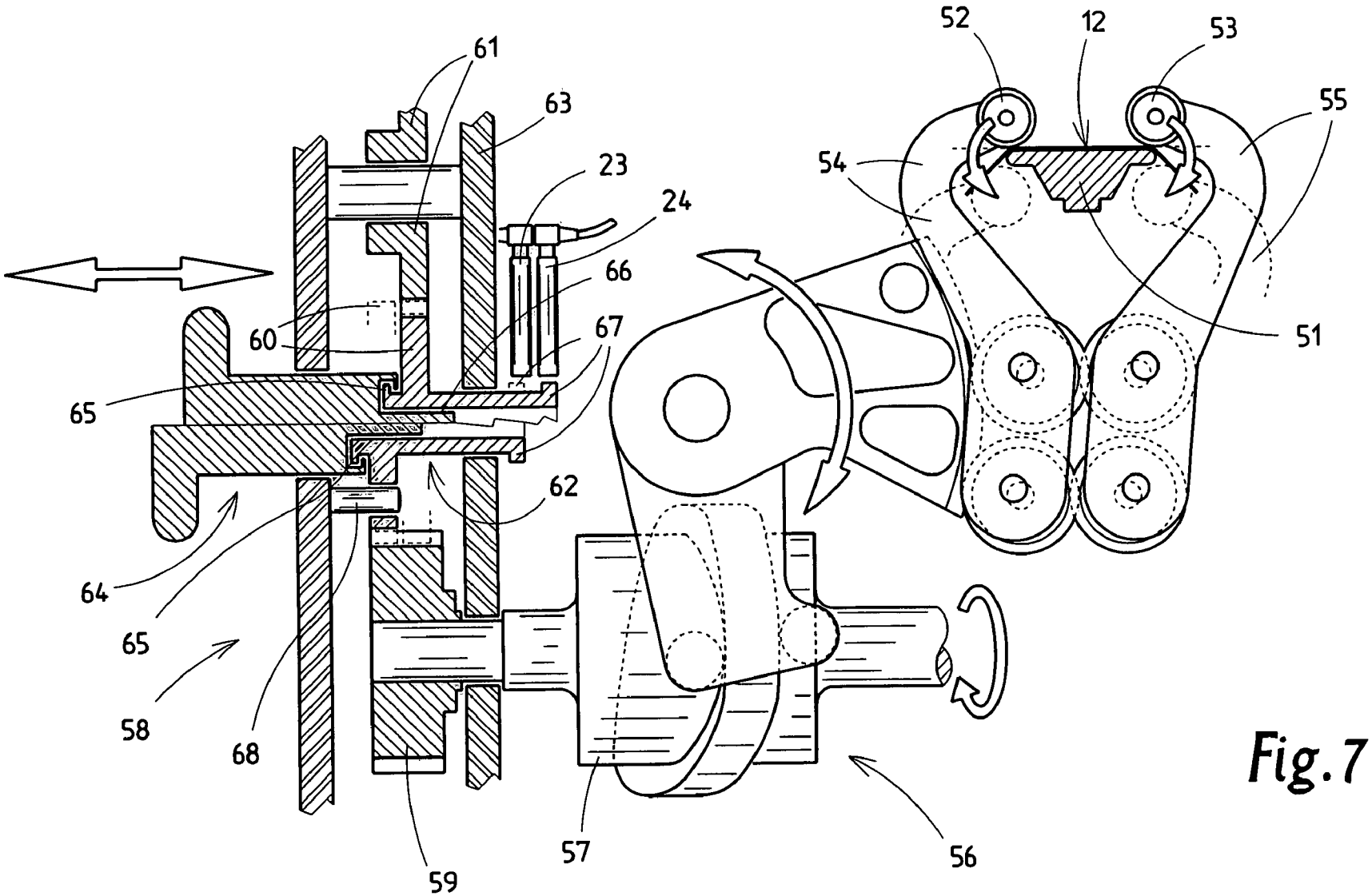
FIG. 7 shows a further folding subassembly of the packaging machine, namely for shaping collar blanks, in elevation or along upright sectional plane VII—VII from FIG. 1.

FIG. 7 shows another processing subassembly, likewise for producing round-edged packs 14. It is also provided here that the subassembly is present as standard in the packaging machine and is set in operation or stopped independence on the pack which is to be produced.

This subassembly is intended for preparing a blank for a collar 12. The blanks severed from a continuous web are fed to a collar subassembly corresponding to FIG. 7 and, in the region thereof, prepared in respect of the round edges which are to be produced, the round edges being provided between a collar front wall and corner side tabs. For this purpose, the collar subassembly has a stationary shaping body 51, which is positioned in the movement path of the collar 12 and has rounded contours on both sides. Projecting regions of the collar 12 for forming the collar side tabs are integrally formed by shaping tools, namely by rollers 52, 53, by virtue of the latter moving correspondingly on the lateral, rounded contours of the shaping body 51 (EP 0 667 232).

The rollers 52, 53 are fitted on adjusting levers 54, 55. These are actuated in the manner described by a specific gear mechanism 56. The gear mechanism 56 contains a cam roller 57 which is driven in rotation. The latter, in turn, is moved via a further gear mechanism, namely a preliminary gear mechanism 58, by way of a central drive. During the production of a type of pack without round edges—the standard pack 13 or octagonal pack 15—the drive for the roller 52, 53 is brought to a standstill, to be precise with the rollers 52, 53 in a position beneath the shaping body 51 (dashed lines in FIG. 7). Disconnection takes place in the region of the preliminary gear mechanism 58.

The cam roller 57 is driven by a gearwheel 59, which engages with an intermediate wheel 60. The latter, in turn, meshes with a drive wheel 61 of a central drive.

The drive is disconnected by adjustment of the intermediate wheel 60, such that the latter disengages from the drive wheel 61. For this purpose, the intermediate wheel 60 is displaced axially into a position (dashed lines in FIG. 7) alongside the drive wheel 61. The connection to the gearwheel 59, which is dimensioned correspondingly in the axial direction, is maintained.

In order to execute this displacement, the intermediate wheel 60 is fitted on a spindle, namely hollow spindle 62. The latter can be displaced axially in a carrying wall 63 of the machine framework. On one side, an actuating element 64 is connected to the hollow spindle 62. The actuating element 64 is adjusted axially by hand and is designed with a corresponding widened portion at the end.

Connection between the actuating element 64 and the intermediate wheel 60 which is to be adjusted is such that rotary movements of the intermediate wheel 60 are not transmitted to the actuating element. For this purpose, the spindle of the intermediate wheel 60 is designed as hollow spindle 62, into which the actuating element 64 enters by way of a centering component 66. A claw-like connection 65 allows the transmission of axial forces, but permits relative rotary movements.

Once again, two initiators 23, 24 are provided in order to check the correct position of the gear mechanism and/or of the coupling brought about by the pack which is to be produced. Said initiators are assigned to a thickened portion or a contact border 67 at the end of the hollow spindle 62. The latter has a corresponding length projecting through an opening in the carrying wall 63. Depending on the position of the hollow spindle 62, and thus of the intermediate wheel 60, the contact border 67 acts on one initiator 23, 24 or the other.

The two examples according to FIGS. 4, 5 and 6, on the one hand, and according to FIG. 7, on the other hand, are provided with a securing means for the disconnected elements or gear-mechanism parts, with the result that these are locked in a certain position which is appropriate for operation of the packaging machine. In the case of the example of FIG. 6, the pivoting lever 41 is anchored in the inactive position by an arresting pin 68 in the housing component 39. In the case of the exemplary embodiment of FIG. 7, the arresting pin 68 is fitted on a housing wall and enters into a bore of the intermediate wheel 60 when the latter is located in the disconnected position. The elements or wheels which are to be fixed in certain relative positions are arrested by displacement relative to a stationary arresting pin 68 or the like.

Figure 8:
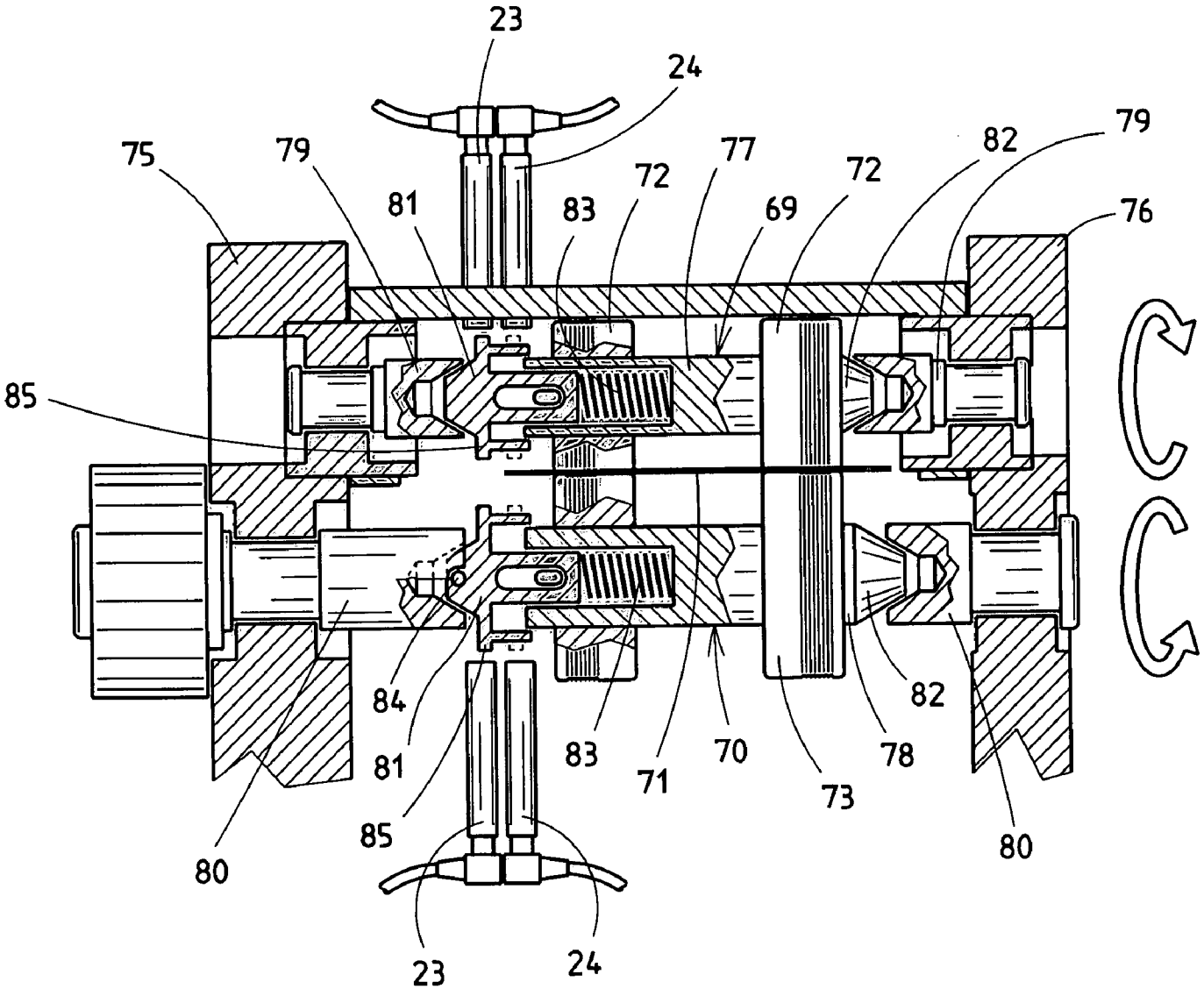
FIG. 8 shows a processing subassembly for blanks, namely a scoring subassembly, partly along axially running sectional plane VIII—VIII from FIG. 1.

FIG. 8 shows a particular example in which it is necessary to remove elements arranged on a rotating shaft or spindle for certain types of packs. The procedure here is such that the relevant spindle 69, 70, with the element arranged thereon, is removed wholly or partially on account of a specifically designed coupling.

The subassembly according to FIG. 8 is used in conjunction with the production of round-edged packs 14. A continuous material web 71 is processed by tools. In the case of the example shown, the material web 71 serves for producing the collars 12. Accordingly, the subassembly, in the production sequence, is arranged upstream of the collar subassembly shown in FIG. 7. The subassembly here is used for producing stamped scores in the region of the round edges which are to be produced. For this purpose, rotating scoring tools, namely corresponding scoring rollers 72, 73, are positioned on both sides in each case, that is to say beneath and above the material web 71.

The scoring rollers 72, 73 are driven. The bottom spindle 70 is, in functional terms, a shaft which is driven by a driving gearwheel 74. Via the material web 71, the top scoring rollers 72 are likewise driven, with corresponding rotation of the top spindle 69.

The ends of the spindles 69, 70 and/or of the (bottom) shaft are mounted for rotation in lateral housing walls 75, 76. A section of the spindles 69, 70 in which the two scoring rollers 72, 73 are fitted, namely a spindle component 77, 78, can be removed (with the scoring rollers 72, 73). For this purpose, the ends of the spindle components 77, 78 are seated in mounts or lateral carrying components 79, 80 as an extension of the spindles 69, 70. The carrying components 79, 80 are mounted in a rotatable manner in each case in the housing walls 75, 76 and have conical depressions on the sides which are directed toward the spindle components 77, 78. Correspondingly conically designed coupling ends 81, 82 of the spindle components 77, 78 enter in a form-fitting manner into said depressions.

For coupling and uncoupling the spindle components 77, 78 in respect of the coupling ends 81, 82, the conical coupling ends 81 in each case can be displaced axially on one side of the spindle components 77, 78, to be precise counter to the loading of a spring 83. The displaceable coupling ends 81, 82 are secured against rotation by a slot guide. By virtue of being displaced from the position which is shown by solid lines in FIG. 8 into the position which is indicated by dashed lines, the conical coupling ends 81 pass out of the depressions of the carrying components 79, 80, with the result that the spindle components 77, 78 are freed. These may then be removed with the scoring rollers 72, 73. During operation, that is to say during use of the scoring rollers 72, 73, the spindle components 77, 78 are connected in a non-rotatable manner to the carrying components 79, 80, to be precise by a transversely directed carry-along pin 84.

Initiators 23, 24 are provided in order to check the presence of the two spindle components 77, 78 (or the absence of these parts), the initiators interacting with a thickened portion 85 in each case on the outside of the spindle components 77, 78. In particular, the thickened portion 85 is provided at the displaceable coupling end 81. Using two initiators 23, 24 in conjunction with a single thickened portion 85 also ensures that an incorrect position of the displaceable coupling end 81 is established by the initiator 24.

Figure 9:
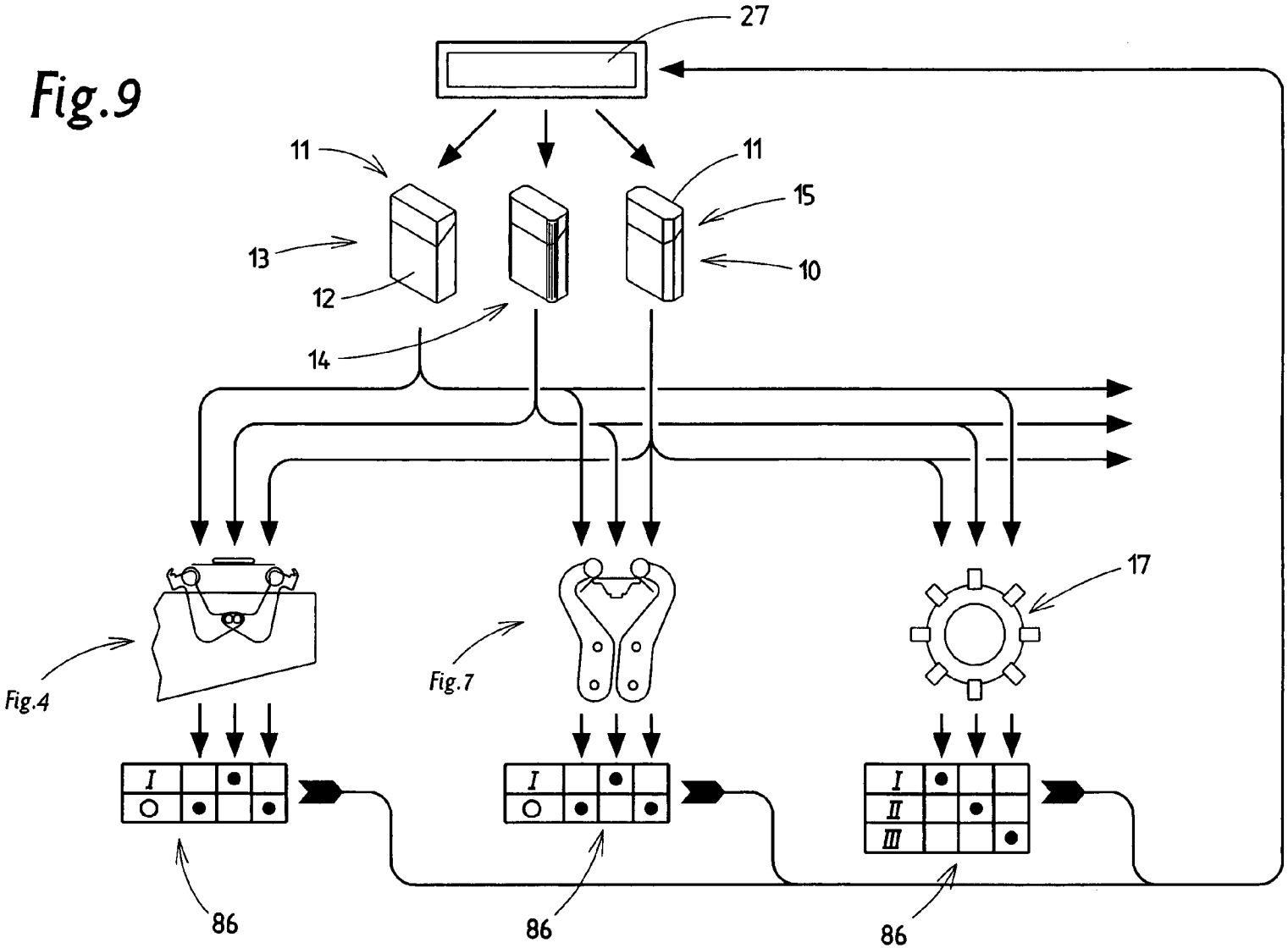
FIG. 9 shows a diagram of a control system for a product changeover.

A functional diagram is illustrated schematically in FIG. 9. By way of the central control means 27, the operator can detect whether the machine has been converted completely to a new type of pack which is to be produced. For this purpose, the type of pack which is to be produced is input into the control means 27. Thereafter, the subassemblies are changed over and/or exchanged as necessary. In the case of the example of FIG. 9, three subassemblies or elements are shown by way of example, that is to say the folding turret 17, the shaping subassembly for round edges according to FIG. 4 and the shaping subassembly for collar blanks according to FIG. 7. The control means 27 signals to the operator when all the subassemblies which are to be exchanged or changed over have been set up for the respective type of pack. The schematic illustrations 86 give a symbolic illustration of the respectively associated functions.

List of Designations

10 Box part
11 Lid
12 Collar
13 Standard pack
14 Round-edged pack
15 Octagonal pack
16 Blank magazine
17 Folding turret
18 Shaft
19 Pocket
20 Screw
21 Carrying flange mechanism
22 Adjusting pin
23 Initiator

24 Initiator
25 Contact ring
26 Contact ring
27 Control means
28 Blank
29 Shaping body
30 Shaping roller
31 Shaping roller
32 Gear mechanism
33 Push rod
34 Intermediate gear mechanism
35 Shaft
36 Cam plate
37 Cam roller
38 Pivoting arm
39 Housing component
40 Actuating shaft
41 Pivoting lever
42 Spherical head
43 Sleeve
44 Adjusting wheel
45 Threaded component
46 Compression spring
47 Annular bearing
48 Coupling part
49 Coupling part
50 Protrusion
51 Shaping body
52 Roller
53 Roller
54 Adjusting lever
55 Adjusting lever
56 Gear mechanism
57 Cam roller
58 Preliminary gear mechanism
59 Gear wheel
60 Intermediate wheel
61 Drive wheel
62 Hollow spindle
63 Carrying wall
64 Actuating element
65 Connection
66 Centering component
67 Contact border
68 Arresting pin
69 Spindle
70 Spindle
71 Material web
72 Scoring roller
73 Scoring roller
74 Driving gearwheel
75 Housing wall
76 Housing wall
77 Spindle component
78 Spindle component
79 Carrying component
80 Carrying component
81 Coupling end
82 Coupling end
83 Spring
84 Carry-along pin
85 Thickened portion
86 Illustration

What is claimed is:

1. An apparatus for production of cigarette packs of the hinge-lid pack type from pack and lid blanks, each pack comprising a box part and a lid, each pack having front, rear and side faces delimited by upright pack edges, said apparatus comprising:

a) means for producing the packs whose said pack edges are right-angled, round or beveled, said means comprising a folding turret having a plurality of shaping pockets in which the blanks are folded around the pack contents during the production of the cigarette packs, said folding turret having stationary, immovable shaping elements, and shaping subassemblies with displaceable rounding tools, said folding turret being arranged in respective configurations corresponding to a cross-sectional design of the pack edges;

b) means to withdraw said displaceable rounding tools in an inoperative position when said displaceable rounding tools do not correspond to the type of pack to be produced;

c) means to interchange said folding turret having said shaping pockets with a second folding turret having a plurality of shaping pockets correspond to a type of pack to be produced and with a respective shape of the pack edges, d) wherein the interchangeable folding turrets are provided with first sensor, and the shaping subassemblies are provided with a second sensor, said first and second sensors having scanning means to scan and to produce scanned data, e) central control means, connected to the first and second sensors for checking the scanned data of the folding turrets that are to be exchanged with respect to correct allocation thereof;

means for generating an error signal on an occurrence of an incorrect said allocation, the central control means checking the scanned data of the second sensor of the shaping subassemblies for the purpose of checking the position of the rounding tools corresponding to the type of pack to be produced in each case; and means for generating an error signal on an occurrence of an incorrect said position of the rounding tools corresponding to the type of pack to be produced.

2. The apparatus according to claim 1, characterized by the following features:

a) said central control means displays changes to be executed for the intended changeover to the type of pack to be produced, and b) said central control means generates a signal after the changes to the folding turrets and shaping subassemblies have been completely and correctly executed.

3. The apparatus according to claim 1, characterized in that the rounding tools, including the gear mechanism assigned to the rounding tools, are uncoupled from a drive in order to deactivate corresponding rounding tools.

4. The apparatus according to claim 3, characterized by the following features:

a) the gear mechanism for executing the movement of the rounding tools is assigned a further intermediate gear mechanism or a preliminary gear mechanism, which in each case is connected to the drive, and b) means for uncoupling the drive for the rounding tools in a region of the intermediate gear mechanism or of the preliminary gear mechanism.

5. The apparatus according to claim 3, characterized by the following features:

a) a drive shaft or actuating shaft is connected to a driven actuating means via a coupling which is actuated from the outside, and b) means for releasing the actuated coupling to uncouple the driven actuating means from the drive.

6. The apparatus according to claim 5, characterized by the following features:

a) the actuating means is mounted on an actuating shaft by means of an adjustable mount or sleeve, and b) the coupling is actuated by axial displacement of the sleeve.

7. The apparatus according to claim 6, characterized by the following features:

a) the sleeve is displaced by an adjusting wheel which can be operated from the outside, b) first coupling part of said coupling is connected to the sleeve, and c) a second coupling part associated with the coupling is connected to the actuating shaft.

8. The apparatus according to claim 3, characterized in that in order to uncouple a shaping subassembly or rounding tool from the drive, an intermediate wheel, designed as a gearwheel and being driven, is disengaged from adjoining gearwheels, namely disengaged from a gearwheel assigned to the gear mechanism, by axial displacement.

9. The apparatus according to claim 8, characterized in that said intermediate wheel is adjustable in the axial direction by an actuating element, which is operable from the outside.

10. The apparatus according to claim 1, characterized by the following features:

a) a shaping subassembly, for preparing blanks or a continuous material web for the production of said blanks has scoring rollers for applying continuous scoring by means of embossing, in a region of the rounded edges of a round-edged pack, and b) the scoring rollers are arranged on a rotary shaft or spindle, c) during a changeover for the type of pack to be produced, namely one without scoring, means for removing the shaft or spindle, bearing the scoring rollers, from the shaping subassembly.

11. The apparatus according to claim 10, characterized by the following features:

a) the spindles bearing the scoring rollers have a decouplable spindle component, b) the spindle components are mounted by conical coupling ends in correspondingly configured recesses of rotary carrying components which are mounted in a stationary manner.

12. The apparatus according to claim 1, characterized in that the folding turrets which are to be exchanged, or the rounding tools which are lockable in said starting, inoperative position, have elevations or thickened portions, each of which is arranged adjacent to one or more initiators, and wherein the first sensor is activated in a first position, and the second sensor is activated in a second position.

13. The apparatus according to claim 1, characterized in that at least one rotary element of a drive is fixable in a withdrawn, inoperative position of a rounding tool by means of a fixing pin which enters an opening of the rotary element—intermediate wheel.

* * * * *